US006286435B1

(12) United States Patent
Kassab et al.

(10) Patent No.: US 6,286,435 B1
(45) Date of Patent: Sep. 11, 2001

(54) APPARATUS FOR LIFTING AND SHIFTING A LONG LOAD

(75) Inventors: Gabe M. Kassab, Pittsburgh, PA (US); Jon Odden, Coon Rapids, MN (US)

(73) Assignee: Kasgro Rail Corp., New Castle, PA (US)

( * ) Notice: Subject to any disclaimer, the term of this patent is extended or adjusted under 35 U.S.C. 154(b) by 0 days.

(21) Appl. No.: 09/255,595

(22) Filed: Feb. 22, 1999

Related U.S. Application Data

(60) Provisional application No. 60/075,578, filed on Feb. 23, 1998.

(51) Int. Cl.[7] ..... B61D 1/00

(52) U.S. Cl. ..... 105/171; 105/433

(58) Field of Search ..... 105/171, 164, 105/185, 194, 199.1, 209, 358, 362, 433, 455, 4.2, 4.1, 453, 3; 280/6

(56) References Cited

U.S. PATENT DOCUMENTS

| | | | | |
|---|---|---|---|---|
| 3,207,087 | * | 9/1965 | Goby | 105/455 |
| 3,245,358 | * | 4/1966 | Schieler | 105/246 |
| 3,704,670 | * | 12/1972 | Dobson et al. | 105/201 |
| 3,911,830 | * | 10/1975 | Adams | 105/164 |
| 3,942,453 | * | 3/1976 | Stabel et al. | 105/265 |
| 3,977,694 | * | 8/1976 | Nordstrom | 280/112 |
| 4,041,879 | | 8/1977 | Cockrell | 105/366 |
| 4,160,420 | | 7/1979 | Hackbarth et al. | 105/367 |
| 4,164,906 | | 8/1979 | Nieviarovski | 105/367 |
| 4,341,494 | | 7/1982 | Fedele | 410/45 |
| 4,780,033 | * | 10/1988 | Walda et al. | 410/1 |
| 5,579,698 | * | 12/1996 | Lis et al. | 105/364 |

* cited by examiner

*Primary Examiner*—S. Joseph Morano
*Assistant Examiner*—Robert J. McCarry, Jr.
(74) *Attorney, Agent, or Firm*—Buchanan Ingersoll, P.C.

(57) ABSTRACT

A rail vehicle for transporting a long load over a railway route can have a depressed portion of the car body and a lift and shift apparatus mounted in the depressed portion which can vertically and horizontally adjust the long load on the rail vehicle. Generally, two such vehicles can be employed to support portions of the long load. The lift and shift apparatus can have a lifter/shifter mechanism provided in the depressed portion and can have hydraulic cylinders connected between the car body and the lifter/shifter for vertically adjusting the long load. An adapter receiver can be provided adjacent and slideable relative to the lifter/shifter. A saddle adapter can be provided adjacent to the adapter receiver. The saddle adapter can be rotatable relative to the adapter receiver. A saddle can be provided intermediate the saddle adapter and the long load. Hydraulic cylinders can be connected horizontally between side portions of the saddle adapter and side portions of the lifter/shifter for laterally adjusting the long load. Friction reducing pads can be provided between the adapter receiver and the lifter/shifter.

28 Claims, 8 Drawing Sheets

APPARATUS FOR LIFTING AND SHIFTING A LONG LOAD

This application benefit to provisional application Ser. No. 60/075,578, filed Feb. 23, 1998

BACKGROUND

The present invention relates to railway vehicles for transporting long loads and, more particularly, to a railway vehicle having a depressed central portion and an assembly mounted in the depression which can horizontally and vertically shift at least a portion of a long load carried by the vehicle.

Conventionally, railway transport vehicles commonly referred to as "Schnabel" cars have often been employed to transport very large or heavy loads over the railways. In a Schnabel car arrangement the load is carried between two Schnabel cars. The two Schnabel cars are able to position the load low to the track by dispensing with the need for a car directly under the load. The load itself is suspended over the tracks as it is connected between each of the Schnabel cars. Each ends of the load is connected to mounting portions on each car of the Schnabel cars. The mounting portions are generally positioned as low to the track as feasible for the load being carried. Schnabel cars conventionally require that the load being carried transmit compressive forces between the two cars of the arrangement. Some examples of Schnabel type cars are disclosed in U.S. Pat. Nos. 4,041,879 to Cockrell; 4,160,420 to Hackbarth et al.; 4,164,906 to Nieviarovski and 4,341,494 to Fedele. Cockrell and Fedele also disclose that, instead of the load being suspended with nothing between the bottom of the load and the tracks, there can be a support platform or carrier bars connected between the lower mounting portions of each of the Schnabel cars. The load can then be supported on the platform or bars. Fedele, additionally discloses that the load may be shifted laterally during transport to avoid obstructions along the tracks and also to maintain a desired pivot center to avoid overloading of the outside set of wheels of the cars. Hackbarth further discloses that the load can be vertically raised or lowered as well as shifted laterally in order to accommodate obstructions along the tracks during transport.

However, in each case the solution to keeping the load low to the tracks has been to use Schnabel type cars whereby the load, or a load supporting member, is suspended low over the tracks. Additionally, if the capability to raise, lower or laterally shift the load is desired, each half of the Schnabel car arrangement would have to be equipped with the appropriate equipment to performing the lifting/shifting functions. An example of such equipment is disclosed in Fedele referred to above. Furthermore, with the Schnabel car arrangements, the load being transported is normally required to be subjected to, and to transfer, compression forces between the two Schnabel cars.

Besides the object being transported having to bear compression loads, there is a practical maximum length of an object which can be transported by Schnabel cars. This is because in very long loads having a large length to height ratio, the compression forces transmitted by the load are inadequate to balance the torque created at the mounting points between the load and the Schnabel cars. Consequently, Schnabel cars can be unsuitable for transporting long loads which have a low profile.

It has also been known to transport very long loads, for example, on flat bed railway transport vehicles. A flat bed car can be a span bolster carried on multiple truck assemblies.

An example of such is a twelve axle rail vehicle as disclosed in commonly owned co-pending U. S. patent application Ser. No. 08/816,388, which is hereby incorporated herein by reference. However, flat bed vehicles can have problems providing a low enough carrying height for the long load. Additionally, since multiple flat bed cars can be required for a very long load, equipment for laterally shifting the load on the bed of the cars can be necessary for the train to avoid obstructions and negotiate turns along the transport route. Also, even where conventional equipment has been employed on the flat beds for lifting or shifting the load, there have can be problems providing a stable, secure manner of shifting the load. If stability is not maintained, the load can actually become dislodged off of the rail vehicle which can result in injury to others, damage to the load and delays for other rail vehicles along the route.

Accordingly, there is a need for a railway transport vehicle and apparatus for transporting long loads along railways which can provide a relatively low transport height which can securely adjust portions of the long load both laterally and vertically to negotiate turns and avoid obstructions along the railway route. Furthermore, such transport should not require the object transported to bear compressive forces.

SUMMARY

A rail vehicle and apparatus for transporting a long load according to the invention can be a flat car having a depressed bed portion and raised bed portion with a lift and shift apparatus mounted in the depressed portion for vertically and laterally adjusting the position of a long load being transported thereon. Generally, two such vehicles can be employed, typically near opposite ends of the long load, for supporting portions of the long load on the rail vehicles.

The lift and shift apparatus can include a lifter/shifter mechanism provided on the car body of each rail vehicle, preferably in a depressed bed portion thereof. Hydraulic cylinders can be mounted between the car body and the lifter/shifter for vertically adjusting the long load by raising or lowering it on the bed. An adapter receiver can be provided adjacent the lifter/shifter and can be slideable relative thereto. The slideable connection can permit lateral adjustment capability. Next, a saddle adapter can be provided adjacent the adapter receiver and can be rotatable relative thereto. The rotational connection can permit the long load some freedom to rotate as needed to facilitate negotiation of turns along the transport route. Hydraulic cylinders can be connected horizontally between side portions of the saddle adapter and side portions of the lifter/shifter to implement lateral adjustment of the long load. A saddle can be provided which can have one end configured to connect to a portion of the long load and an opposite end configured to connect to the saddle adapter. The lifter/shifter can also have a channel provided, wherein the adapter receiver can be slideably received. As the hydraulic cylinders move the saddle adapter it can slide laterally within the channel. In addition, friction reducing bearing pads can be provided on the bottom and sides of the adapter receiver and in the channel for facilitating the sliding lateral movement. Also, pins can be provided for locking the adapter receiver and the lifter/shifter in the laterally shifted positions. Similarly, a spacer bar can be provided for insertion between the lifter/shifter and the car body to block the long load in a vertically adjusted position in case the hydraulic cylinders should malfunction.

Other details, objects, and advantages of the invention will become apparent from the following detailed description and the accompanying drawing figures of certain embodiments thereof.

BRIEF DESCRIPTION OF THE DRAWINGS

A more complete understanding of the invention can be obtained by considering the following detailed description in conjunction with the accompanying drawings, wherein.

DETAILED DESCRIPTION CERTAIN EMBODIMENTS

Figure 1:
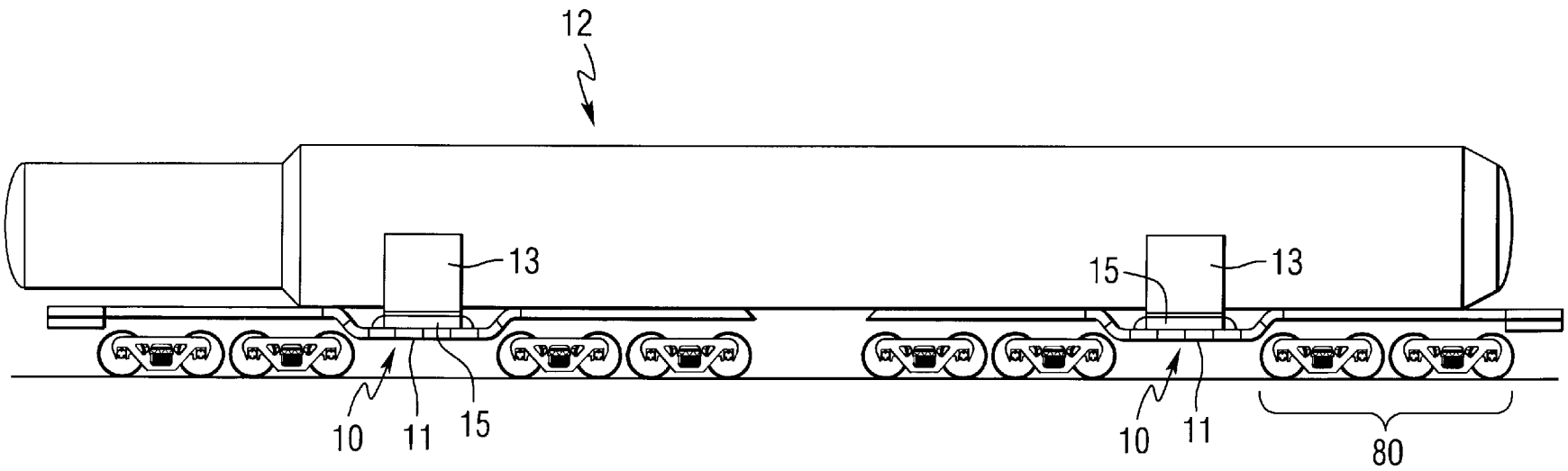
FIG. 1 shows a long load being transported on a pair of transport rail vehicles having a depressed bed portion wherein lifter/shifter apparatus according to the invention is disposed.

Referring now to the drawing figures wherein like reference numbers refer to similar elements throughout the several views, a pair of railway vehicles 10 for transporting a long load is shown in FIG. 1. Each railway vehicle 10 can have a lifting and shifting apparatus 15 mounted in a depressed portion 11 of the bed 16 of the railway vehicle 10 and a saddle 13 for connecting to and supporting the long load 12. Preferably, the depressed portion 11 can be intermediate raised portions end portions of the bed 16 under which truck assemblies 80 support the rail vehicle 10.

Figure 2C:
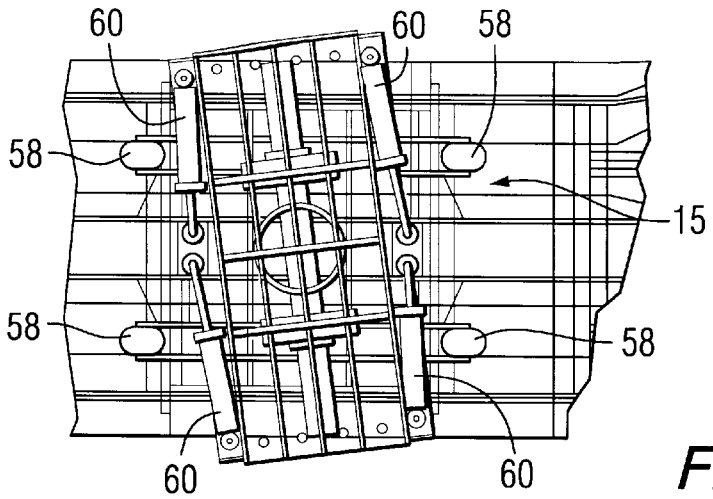
FIG. 2*c* illustrates how the lifter/shifter equipment shown in FIG. 2*a* can rotate to negotiate turns.
Figure 2B:
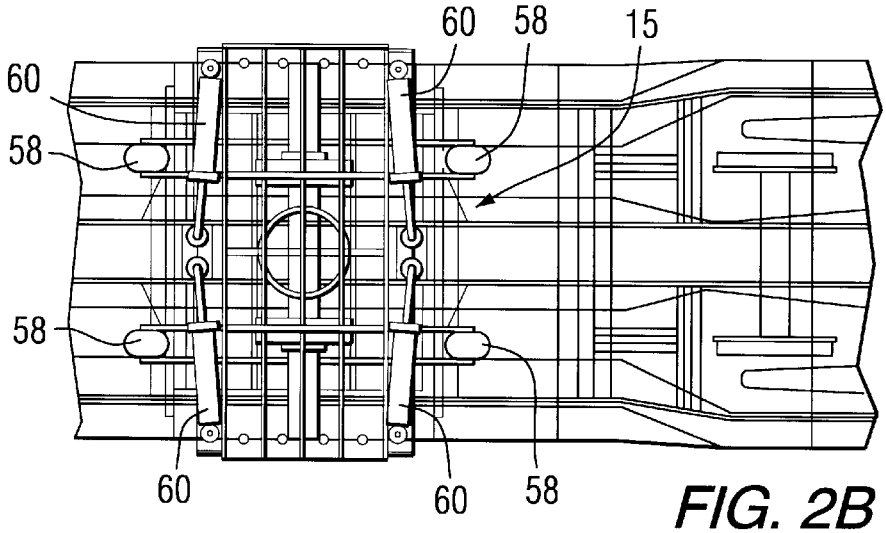
FIG. 2*b* is a top view of FIG. 1.
Figure 2A:
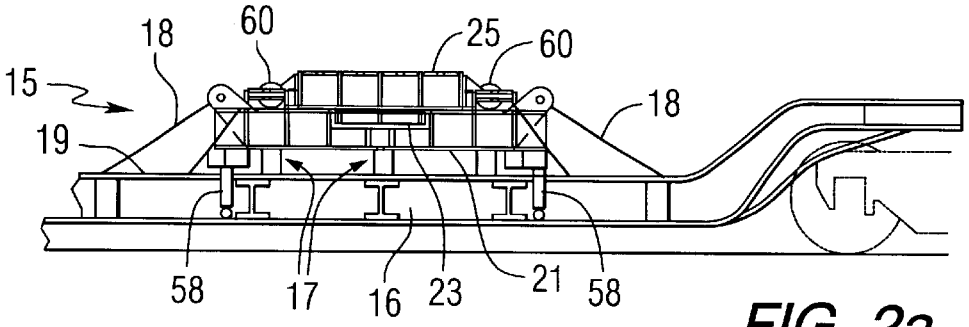
FIG. 2*a* is a side view partially in section of the depressed bed transport vehicle and the lifter/shifter equipment.
Figure 3C:
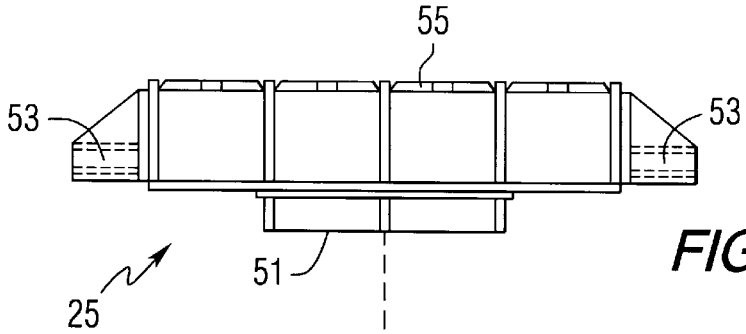
FIG. 3 is an exploded enlarged view of a lifter shifter mechanism, adapter receiver and saddle adapter according to the invention.
Figure 3B:
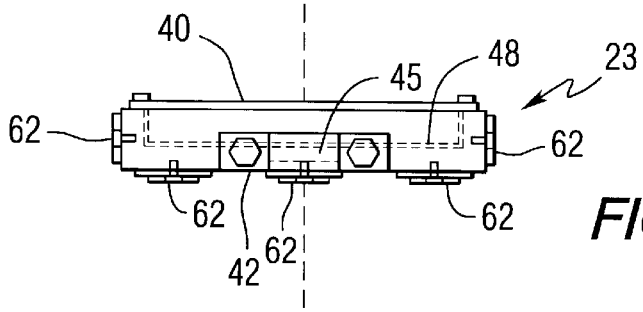
Figure 3A:
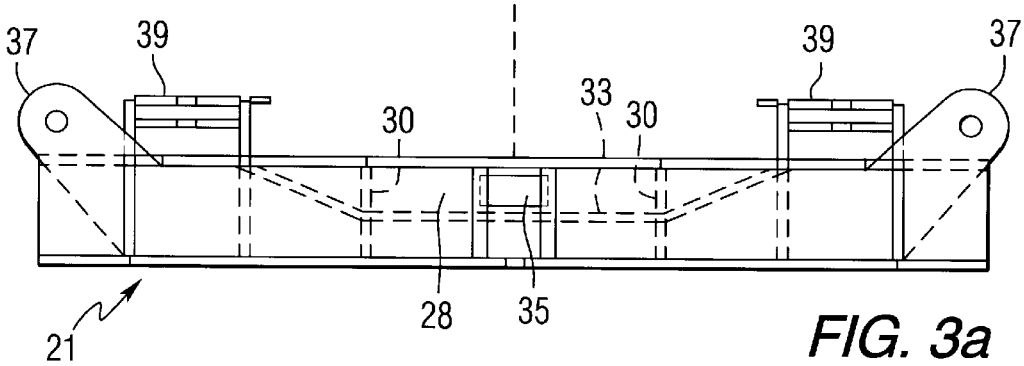
Figure 4B:
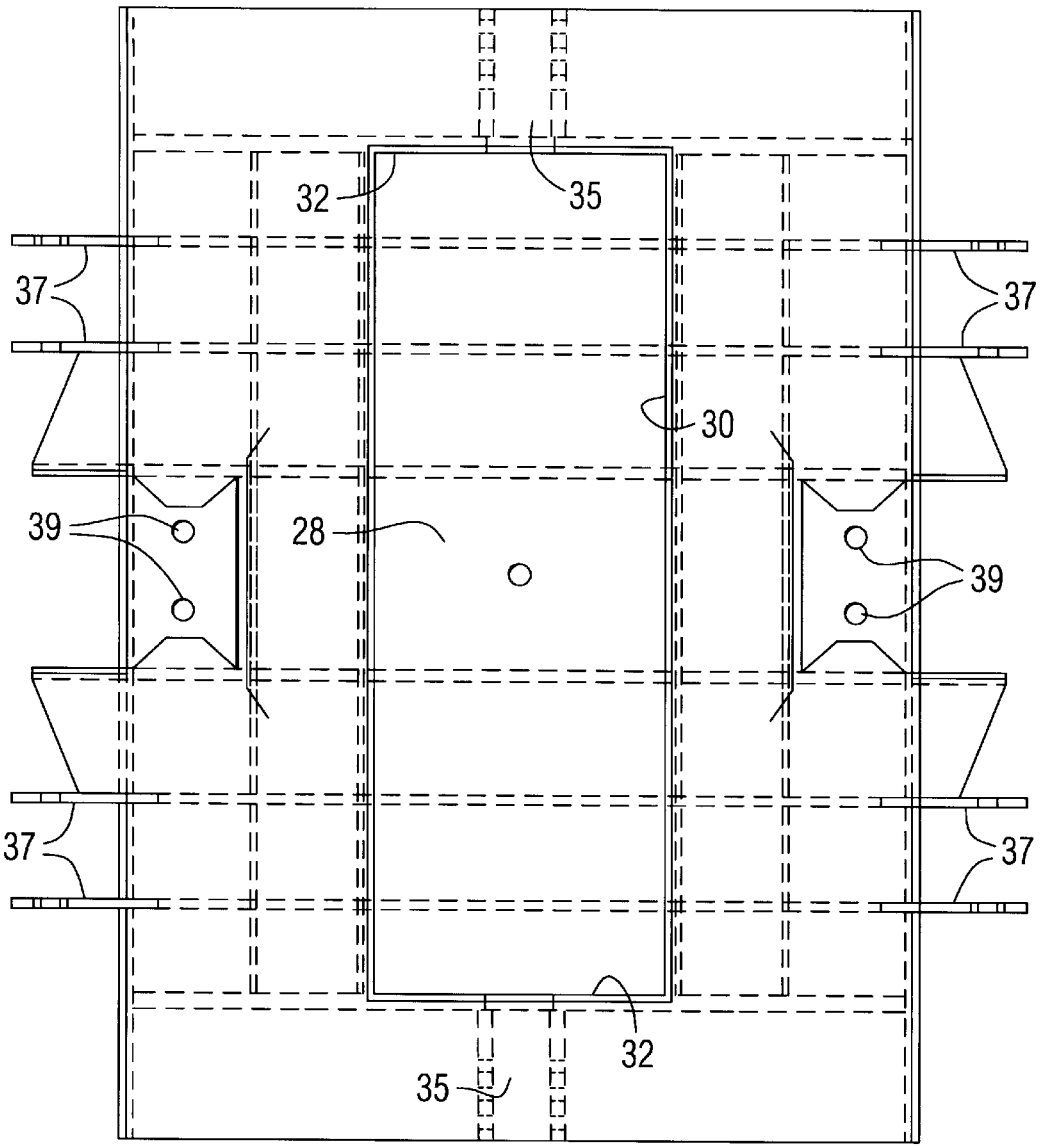
FIG. 4*b* is a top plan view of the adapter receiver shown in FIG. 4.
Figure 4A:
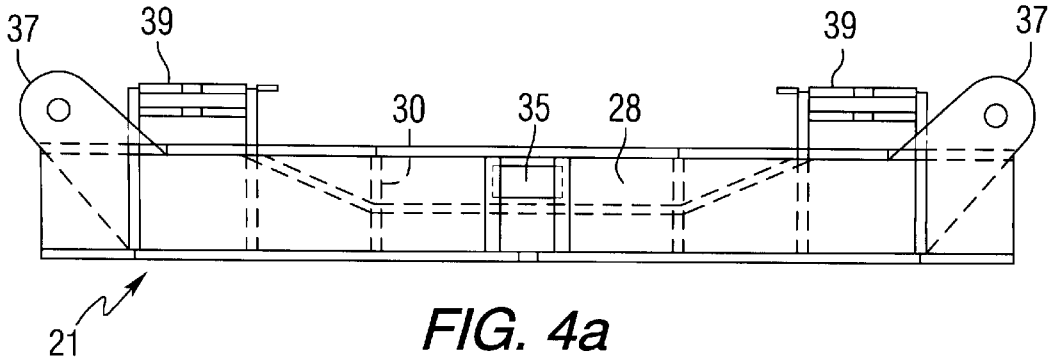
FIG. 4*a* is a side view of the lifter shifter mechanism shown in FIG. 3.

The lifting and shifting apparatus 15 can be mounted on frame blocks 17 on the upper surface 19 of the bed 16 as shown in FIGS. 2*a*–2*c*. Side frame members 18 can be provided on the upper surface 19 at each comer of the lifting and shifting apparatus 15 to secure the apparatus within the depressed portion 11. The lifting and shifting apparatus 15 can have a lifter/shifter member 21 mounted in the depressed portion 11 on the frame blocks 17. An adapter receiver 23 can be mounted on the lifter/shifter 21 below a saddle adapter 25 on which the saddle 13 can be mounted. Four vertical hydraulic cylinders 58, as shown in FIGS. 2 and 2A, can provide the vertical lift for the lifting and shifting equipment 15 and four horizontally positioned hydraulic cylinders 60 provide lateral shifting of the long load 12.

Figure 8:
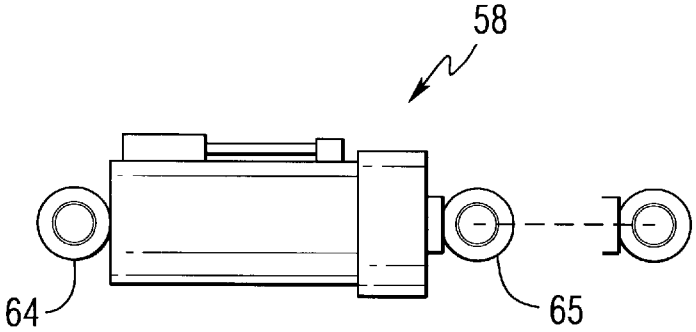
FIG. 8 shows a vertical lift hydraulic cylinder.

Referring to FIGS. 3*a*–4*b*, the lifter/shifter 21 can have a channel 28 defined by a bottom surface 33, two sidewalls 30 and end walls 32 wherein the adapter receiver 23 can be slideably received. A guide channel 35 can be provided through the end walls 30 at either end of the channel 28. Mounting portions 37 for the vertical hydraulic cylinders 58 can be provided near each of the four comers of the lifter/shifter at 21 to which the rod end 65 of the vertical hydraulic cylinders 58, shown in FIG. 8, are mounted. Further, mounting portions 39 for the horizontal hydraulic cylinders 60, shown in FIG. 9, can be provided at central locations on the top of the lifter/shifter 21. The rod ends 68 of the horizontal hydraulic cylinders 60 are mounted at these mounting portions 39.

Figure 5B:
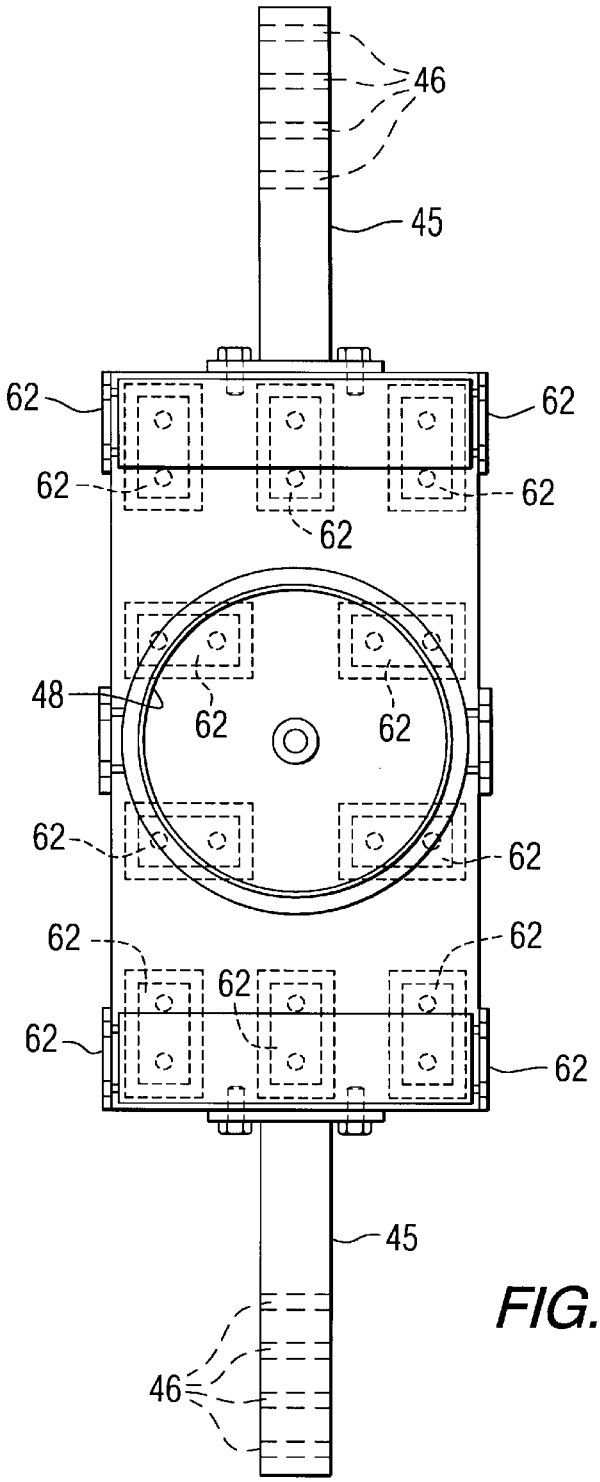
FIG. 5*b* is a top plan view of the adapter receiver shown in FIG. 5.
Figure 5A:
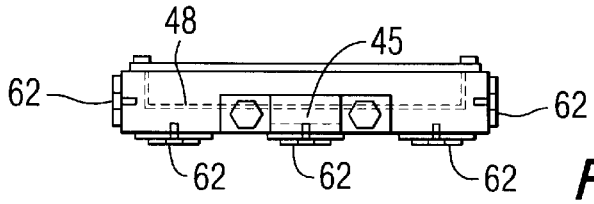
FIG. 5*a* is a side view of the adapter receiver shown in FIG. 3.

Referring now to FIGS. 5*a*–5*b*, a guide arm 45 can extend from each end of the main body of the adapter receiver 23. When the adapter receiver 23 is slidingly disposed in the channel 28 in the lifter/shifter 21, each guide arms 45 can extend through a guide channels 35 provided in the end walls 30 of the lifter/shifter 21. Multiple holes 46 can be provided through the ends of the guide arms 45 and the guide channels 35 through which retaining pins can be inserted to lock the adapter receiver in different laterally shifted positions. A plurality of bearing pads 62 can be provided on the bottom and sides of the adapter receiver 23 which slides in the channel 28 of the lifter/shifter 21. The side bearing pads 62 can have a slight clearance between the sidewalls 30 of the channel 28 in the lifter/shifter 21. This clearance can provide stability in the "rock and roll" encountered during the shipment of the long load 12 over the rails. The bearing pads 62 can be made of a friction reducing material to provide a reduced friction contact for the adapter receiver 23 to slide in the channel 28. Preferably, the friction material can be NYLATRON™ The bearing pads 62 can provide a low friction interface between the lifter/shifter 21 and the adapter/receiver 23 to facilitate the lateral shifting of the long load 12 such that less force is required. Additionally, the pads eliminate the need for other type of provision to provide a slideable interface, such as rollers. The adapter/receiver 23 can also have a center plate and a cylindrical female pocket 48 provided therein.

Figure 6B:
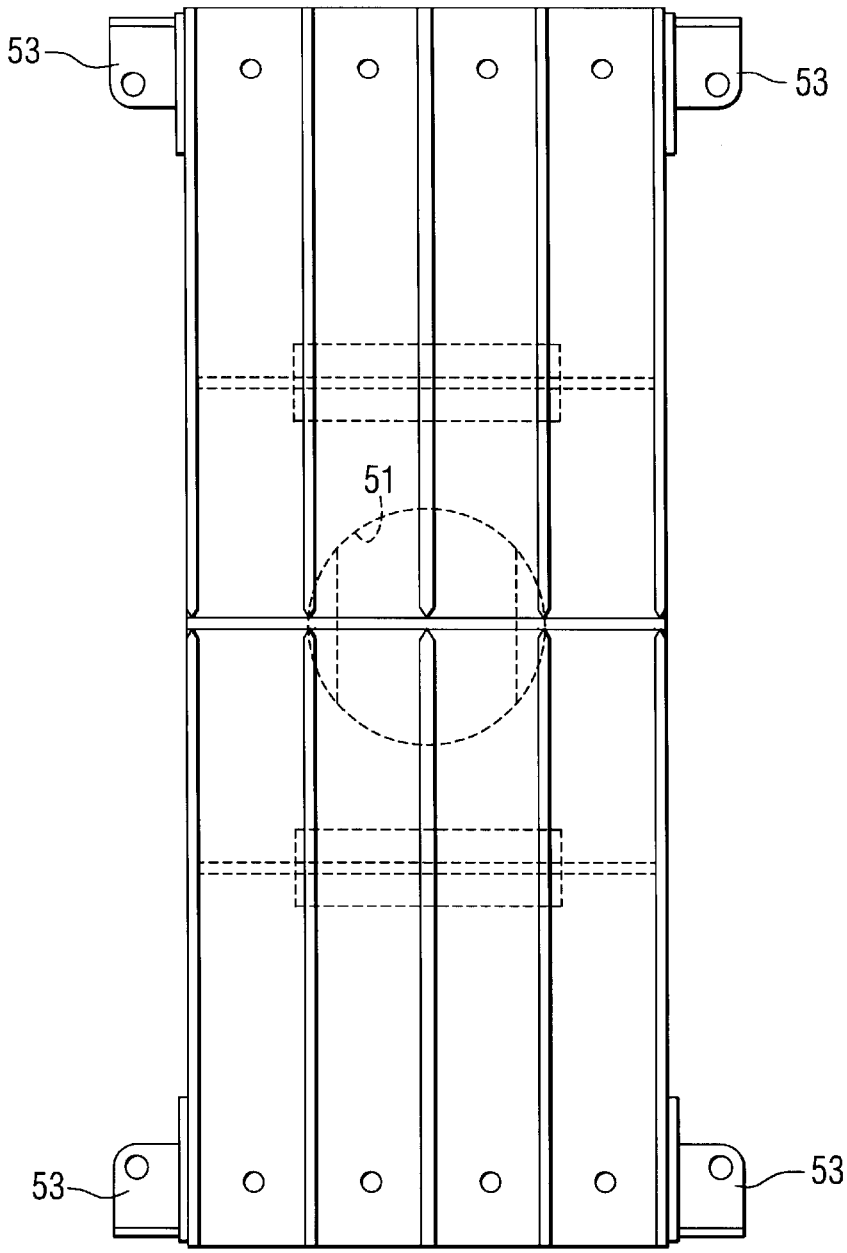
FIG. 6*b* is a top plan view of the saddle adapter shown in FIG. 6.
Figure 6A:
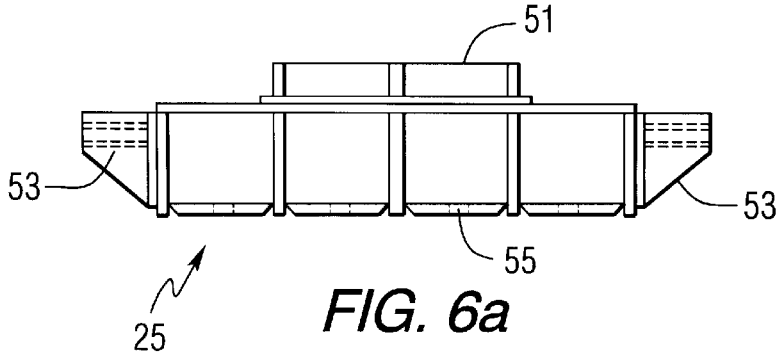
FIG. 6*a* is a side view of the saddle adapter shown in FIG. 3.

Referring now to FIGS. 6*a*–6*b*, the saddle adapter 25 is shown having a top surface 55 on which can be mounted the saddle 13 for interfacing with the load 12 to be transported. A center plate 51 having a male cylindrical connector on the lower surface of the saddle adapter 25 can be provided for mating with the female cylindrical pocket on the center plate 48 of the adapter receiver 23. The mating cylindrical pocket interface between the saddle adapter 25 and the adapter receiver 23 permit the saddle adapter 25 to rotate with the load as the vehicle negotiates curves, as shown in FIG. 2B. Mounting portions 53 can be provided at the comers of the saddle adapter 25 to which the base end of 67 the horizontal hydraulic cylinders 60 can be mounted. The saddle adapter 25 can be provided so that the loading can be handled at the manufacturer (of the long load 12). The manufacturer can design and construct the saddle 13 in the desired form and simply connect it to the saddle adapter 25. However, it is to be understood that the saddle 13 itself could be constructed to connect to the adapter receiver 23 itself such that a saddle adapter 25 would not be necessary. Alternatively, the saddle adapter 25 could be configured to connect to the long load, in which case the saddle 13 would not be needed.

Figure 7:
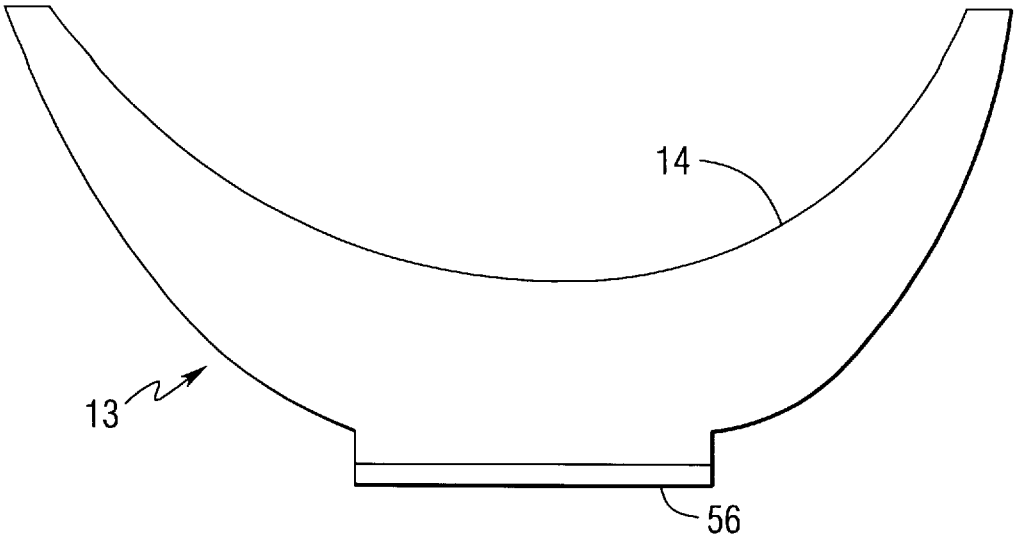
FIG. 7 is a front view of a saddle.

The saddle 13 is illustrated in FIG. 7 having an upper interface surface 14 which can be configured to carry the load which is to be transported. Although the interface surface 14 is shown having an arcuate shape, which could, for example, be appropriate when transporting a cylindrical load, the interface surface 14 could also be designed in other shapes to hold and support differently shaped loads. A lower portion of 56 of the saddle 13 can be configured for mounting the saddle 13 on the saddle adapter 25. Preferably, the saddle 13 can be rigidly connected to the saddle adapter since rotational movement can be provided for by the cylindrical mating connectors on the adapter receiver 23 and the saddle adapter 25.

Referring now to FIGS. 8, four vertically mounted hydraulic cylinders 58 can be provided at each comer of the lifter/shifter 21 for providing the vertical lift capability for the load 12. The rod end 65 of each vertical hydraulic cylinder 58 can be connected to the lifter/shifter 21 at the mounting supports 37 while the base end 64 of the vertical hydraulic cylinders 58 can be connected the frame of the car body 16. To transport the load 12 under bridges or through tunnels, for example, the train can be stopped and the vertical hydraulic cylinders 58 operated to raise the load a small amount, such as a couple of inches, to remove the frame blocks 17. Next, the vertical hydraulic cylinders 58 can be operated to allow the load 12 to be lowered closer to the surface 19 of the car body 16. Gravity and counter balance valves hold the load 12 against the car body 16. The train then resumes travel past the bridge or tunnel, preferably stops again and the procedure described above is reversed before the train continues along the route.

Figure 9:
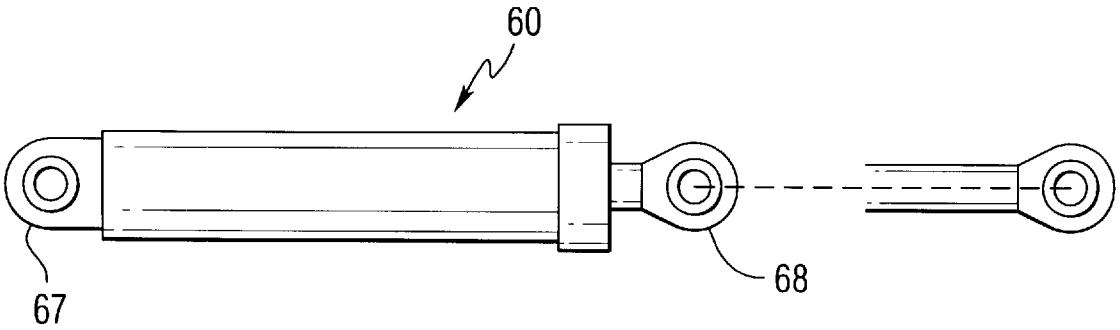
FIG. 9 shows a horizontal lift hydraulic cylinder.
Figure 10:
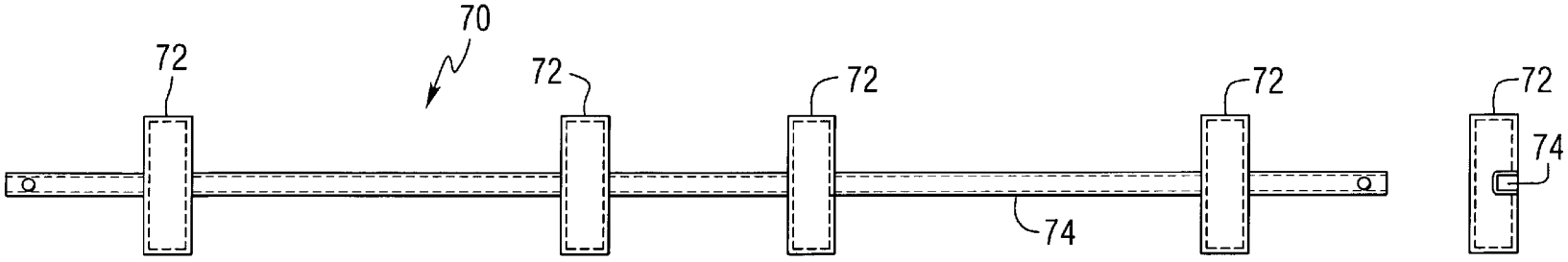
FIG. 10 shows a lifter shifter mechanism support bar.
Figure 11:
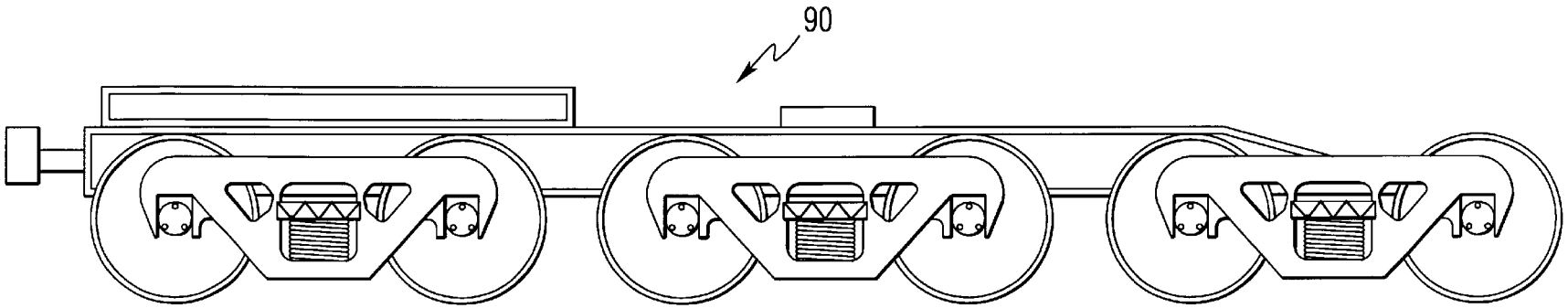
FIG. 11 shows a six axle truck assembly for a 12 axle rail vehicle.

In FIG. 9, horizontal hydraulic cylinders 60 are shown which can be utilized to provide the lateral shifting capability for the long load 12. The rod end 68 of the horizontal hydraulic cylinders 60 can be connected to the support mounts 39 on the lifter/shifter 21 while the base end 67 of the horizontal hydraulic cylinders 60 can be connected to the mounting supports 53 provided at each comer of the saddle adapter 25. To perform a lateral shift, the train can be brought to a stop just prior to encountering the obstruction to be avoided. The lock pins, which can be inserted through the holes 46 in the guide arms 45 of the adapter receiver 23 and the guide channels 35 to lock the long load 12 in position, can be removed to permit the lateral shift to occur. The horizontal hydraulic cylinders 60 can then be operated to laterally move the long load 12 to the desired position. The lock pins can then be reinserted to retain the long load 12 in the shifted position and the train then moves the long load 12 past the obstruction. Preferably, the train can stop once past the obstruction and the procedure described above is reversed before the train resumes travel.

As shown, four hydraulic cylinders 60 are employed for accomplishing each of the vertical and horizontal adjustments, but it is to be understood that more, or fewer, could be employed depending on the long load 12. In operation of the hydraulic cylinders 60 to shift the long load 12 laterally, the base end 67 of the two horizontal hydraulic cylinders 60 on one side of the long load 12 can be pressurized while the rod end 68 of the two opposing horizontal cylinders 60 is concurrently pressurized. Consequently, the long load 12 was being pushed laterally from one side by one pair of the horizontal hydraulic cylinders 60 and pulled laterally from the other side by the other pair of horizontal hydraulic cylinders 60. However, other methods of operating the horizontal hydraulic cylinders 60 to effect a lateral shift can also be employed. Preferably, no vertical movement can be permitted to occur during the lateral shifting. To lift the long load 12, the four vertical hydraulic cylinders 58 can be synchronized by using a pump to provide each vertical hydraulic cylinder 58 the same amount of hydraulic fluid for each unit of time. The pump can reset at the top and the bottom of the stroke of each vertical hydraulic cylinder 60 so that the lift is always synchronized. Preferably, no lateral movement can be permitted to occur during the raising or lowering of the long load 12. The horizontal hydraulic cylinders 60 should not be operated concurrently with the vertical hydraulic cylinders 58 and the side support members 18 at each corner of the lifter/shifter 21 can prevent any side-to-side or front-to-back movement while the long load 12 is being raised or lowered.

A spacer bar 70 can be provided which can be placed under the lifter/shifter 21 after the load has been vertically shifted. Multiple spacer blocks 72 can be provided along the length of a central bar 74. When one or more of the spacer bars 70 are inserted beneath the vertically raised load the spacer blocks 72 can provide a safety feature in that the spacer blocks 72 will prevent the lifter/shifter 21 from lowering in the event of failure of the hydraulic vertical cylinders 58 or other unforseeable events.

Additionally, instead of each of the transport vehicles 10 being supported on 8 axles, provided by a pair of two-axle truck assemblies 80 on each side of the depressed portion 11, each transport vehicle 10 could be supported on 12 axles, provided by 6 two-axle truck assemblies 90 on each side of the depressed portion 11. The 12 axle rail vehicle 90 can be of the type described in the aforementioned co-pending U.S. patent application Ser. No. 08/816,318.

Although certain embodiments of the invention have been described in detail, it will be appreciated by those skilled in the art that various modification to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A rail vehicle lifting and shifting apparatus for transporting a long load, said lifting and shifting apparatus comprising:

a. a lifter/shifter member mountable on a rail vehicle;

b. vertical lifting member having one end associated with said lifter/shifter member and another end associated with said rail vehicle, said vertical lifting member controllable to vertically move said lifter/shifter member relative to said rail vehicle;

c. an adapter receiver slidably connected to said lifter/shifter member for lateral movement relative to said lifter/shifter member;

d. a saddle adapter having a first side and a second side, said first side rotatably connected to said adapter receiver for rotational movement relative to said adapter receiver and said second side configured to connect to a portion of said long load; and e. lateral shifting member having one end associated with said lifter/shifter member and another end associated with at least one of said saddle adapter and said adapter receiver, said lateral shifting member controllable to laterally move at least one of said saddle adapter and said adapter/receiver relative to said lifter/shifter member.

2. The lifting and shifting apparatus of claim 1 further comprising:

a. a saddle having an upper side and a lower side;

b. said upper side configured to connect to a portion of said long load; and c. said lower side configured to connect to said second side of said saddle adapter.

3. The lifting and shifting apparatus of claim 1 further comprising:

a. said lifter/shifter member having a channel provided therein defined by at least a bottom surface and a pair of side walls; and b. said adapter receiver slidably disposed in said channel, said adapter receiver having a lower surface adjacent said bottom surface of said channel and exterior sides adjacent said pair of side walls of said channel.

4. The lifting and shifting apparatus of claim 3 further comprising at least one of said lower surface and exterior sides of said adapter receiver provided with at least one low friction bearing pad to facilitate sliding movement of said adapter receiver within said channel.

5. The lifting and shifting apparatus of claim 3 further comprising at least one of said bottom surface and pair of side walls of said channel provided with at least one low friction bearing pad to facilitate sliding movement of said adapter receiver within said channel.

6. The lifting and shifting apparatus of claim 3 further comprising a. said channel having a pair of end walls, each end wall having an opening therethrough;

b. a pair of opposed walls extending from said opening in each end wall and outwardly from said channel, said pair of opposed walls defining a guideway;

c. said adapter receiver having a pair of guide arms extending from opposite ends thereof through said opening in each end wall and slidably received in said guideway; and d. each guide way and each guide arm having holes therethrough which axially align at certain positions of said guidearm relative to said guideway whereby when said adapter receiver is laterally moved to any of said certain positions wherein said holes are axially aligned a pin can be inserted through said axially aligned holes thereby locking said adapter receiver at said laterally moved position.

7. The lifting and shifting apparatus of claim 1 wherein said saddle adapter further comprises:

a. a first center plate attached to said first side;

b. said first center plate having a male cylindrical connector;

c. said adapter receiver having a second center plate attached to a side adjacent said first side of said saddle adapter; and d. said second center plate having a female cylindrical connector rotatably connected to said male cylindrical connector whereby said saddle adapter is rotatable relative to said adapter receiver.

8. The lifting and shifting apparatus of claim 1 further comprising:

a. said lifter/shifter member having a plurality of first mounting portions; and b. said vertical lifting member being a plurality of hydraulic cylinders each having a rod end and a base end, said rod end connected to one of said plurality of first mounting portions and said base end connected to said rail vehicle such that operation of said plurality of hydraulic cylinders accomplishes said vertically moving said lifter/shifter member relative to said rail vehicle.

9. The lifting and shifting apparatus of claim 1 further comprising:

a. said lifter/shifter member having a plurality of second mounting portions;

b. said saddle adapter having a plurality of third mounting portions; and c. said lateral shifting member being a plurality of hydraulic cylinders each having a rod end and a base end, said rod end connected to one of said plurality of second mounting portions and said base end connected to said third mounting portions such that operation of said plurality of hydraulic cylinders accomplishes said laterally moving said saddle adapter and said adapter receiver relative to said lifter/shifter member.

10. The lifting and shifting apparatus of claim 1 further comprising at least one spacer bar insertable between said lifter/shifter member and said rail vehicle whenever said lifter/shifter member is vertically moved relative to said rail vehicle whereby once inserted therebetween said spacer bar blocks said lifter/shifter member in said vertically moved position to prevent said lifter/shifter member from inadvertently lowering if said lifting means fails.

11. The lifting and shifting apparatus of claim 10 further comprising said at least one spacer bar having a plurality of spacer blocks provided at spaced apart locations along said spacer bar.

12. The lifting and shifting apparatus of claim 11 further comprising said at least one spacer blocks having a rectangular shape such that said spacer bar can block said lifter/shifter member at two different heights defined by the two different length sides of said rectangular shaped spacer blocks.

13. The lifting and shifting apparatus of claim 1 wherein said rail vehicle has a depressed bed portion and further comprising said lifter/shifter member mounted in said depressed bed portion.

14. The lifting and shifting apparatus of claim 13 wherein said rail vehicle is supported on opposite sides of said depressed bed portions by three two-axle truck assemblies whereby said rail vehicle is supported on twelve axles.

15. A pair of rail vehicles for transporting a long load, each of said pair of rail vehicles comprising:

a. a car body having a flat bed portion;

b. at least one truck assembly on either side of said flat bed portion for supporting said car body thereon;

c. a lifter/shifter member mounted on said flat bed portion;

d. an adapter receiver slidably connected to said lifter/shifter for lateral movement relative to said lifter/shifter member;

e. a saddle adapter having a first side and a second side, said first side rotatably connected to said adapter receiver for rotational movement relative to said adapter receiver and said second side configured to connect to a portion of said long load;

f. vertical lifting member having one end associated with said lifter/shifter member and another end associated with said flat bed portion, said vertical lifting member controllable to vertically move said lifter/shifter member relative to said flat bed portion; and g. lateral shifting member having one end associated with said lifter/shifter member and another end associated with at least one of said saddle adapter and said adapter receiver, said lateral shifting member controllable to laterally move at least one of said saddle adapter and said adapter/receiver relative to said lifter/shifter member.

16. The pair of rail vehicles of claim 15 further comprising:

a. a saddle having an upper side and a lower side;

b. said upper side configured to connect to a portion of said long load; and c. said lower side configured to connect to said second side of said saddle adapter.

17. The pair of rail vehicles of claim 15 further comprising:

a. said lifter/shifter member having a channel provided therein defined by at least a bottom surface and a pair of side walls; and b. said adapter receiver slidably disposed in said channel, said adapter receiver having a lower surface adjacent said bottom surface of said channel and exterior sides adjacent said pair of side walls of said channel.

18. The pair of rail vehicles of claim 17 further comprising at least one of said lower surface and exterior sides of said adapter receiver provided with at least one low friction bearing pad to facilitate sliding movement of said adapter receiver within said channel.

19. The pair of rail vehicles of claim 17 further comprising at least one of said bottom surface and pair of side walls of said channel provided with at least one low friction bearing pad to facilitate sliding movement of said adapter receiver within said channel.

20. The pair of rail vehicles of claim 17 further comprising:

a. said channel having a pair of end walls, each end wall having an opening therethrough;

b. a pair of opposed walls extending from said opening in each end wall and outwardly from said channel, said pair of opposed walls defining a guideway;

c. said adapter receiver having a pair of guide arms extending from opposite ends thereof through said opening in each end wall and slidably received in said guideway; and d. each guide way and each guide arm having holes therethrough which axially align at certain positions of said guidearm relative to said guideway whereby when said adapter receiver is laterally moved to any of said certain positions wherein said holes are axially aligned a pin can be inserted through said axially aligned holes thereby locking said adapter receiver at said laterally moved position.

21. The pair of rail vehicles of claim 15 wherein said saddle adapter further comprises:

a. a first center plate attached to said first side;

b. said first center plate having a male cylindrical connector;

c. said adapter receiver having a second center plate attached to a side adjacent said first side of said saddle adapter; and d. said second center plate having a female cylindrical connector rotatably connected to said male cylindrical connector whereby said saddle adapter is rotatable relative to said adapter receiver.

22. The pair of rail vehicles of claim 15 further comprising:

a. said lifter/shifter member having a plurality of first mounting portions; and b. said vertical lifting member being a plurality of hydraulic cylinders each having a rod end and a base end, said rod end connected to one of said plurality of first mounting portions and said base end connected to said rail vehicle such that operation of said plurality of hydraulic cylinders accomplishes said vertically moving said lifter/shifter member relative to said flat bed portion.

23. The pair of rail vehicles of claim 15 further comprising:

a. said lifter/shifter member having a plurality of second mounting portions; and b. said saddle adapter having a plurality of third mounting portions;

c. said lateral shifting member being a plurality of hydraulic cylinders each having a rod end and a base end, said rod end connected to one of said plurality of second mounting portions and said base end connected to said third mounting portions such that operation of said plurality of hydraulic cylinders accomplishes said laterally moving at least one of said saddle adapter and said adapter receiver relative to said lifter/shifter member.

24. The pair of rail vehicles of claim 15 further comprising at least one spacer bar insertable between said lifter/shifter member and said flat bed portion whenever said lifter/shifter member is vertically moved relative to said flat bed portion whereby once inserted therebetween said spacer bar blocks said lifter/shifter member in said vertically moved position to prevent said lifter/shifter member from inadvertently lowering if said lifting means fails.

25. The pair of rail vehicles of claim 24 further comprising said at least one spacer bar having a plurality of spacer blocks provided at spaced apart locations along said spacer bar.

26. The pair of rail vehicles of claim 25 further comprising said at least one spacer blocks having a rectangular shape such that said spacer bar can block said lifter/shifter member at two different heights defined by the two different length sides of said rectangular shaped spacer blocks.

27. The pair of rail vehicles of claim 15 further comprising said flat bed portion having a depressed portion and said lifter/shifter member mounted in said depressed portion.

28. The pair of rail vehicles of claim 27 wherein said at least one truck assembly further comprises three two-axle truck assemblies whereby said car body is supported on twelve-axles.

* * * * *